United States Patent [19]

Yoshida

[11] 3,964,225

[45] June 22, 1976

[54] DEVICE FOR FIXEDLY CONNECTING PANELS FOR USE IN BUILDING

[76] Inventor: Tsukasa Yoshida, Nikko Danchi 15-202 Nikko-cho No. 1-3, Fuchu, Tokyo, Japan

[22] Filed: Dec. 26, 1973

[21] Appl. No.: 428,044

[52] U.S. Cl. ..... 52/500; 52/616

[51] Int. Cl.[2] ..... E06B 3/24

[58] Field of Search ..... 52/498, 499, 500, 501, 52/616, 208

[56] References Cited

UNITED STATES PATENTS

| | | | |
|---|---|---|---|
| 2,073,277 | 3/1937 | Hohl | 52/616 |
| 2,125,397 | 8/1938 | Owen | 49/DIG. 1 |
| 2,128,870 | 8/1938 | Woelfel | 49/DIG. 1 |
| 2,167,772 | 8/1939 | Owen | 52/616 |
| 2,184,659 | 12/1939 | Attick | 52/500 |
| 2,205,538 | 6/1940 | Owen | 52/397 |
| 2,296,720 | 9/1942 | Lowry | 52/500 |
| 2,993,242 | 7/1961 | Leisibach | 52/398 |
| 3,203,151 | 8/1965 | Bransford | 52/502 |
| 3,217,454 | 11/1965 | Leisibach | 52/500 |
| 3,487,580 | 1/1970 | Holliday | 49/DIG. 1 |
| 3,509,673 | 5/1970 | Witkosky | 52/497 |
| 3,750,358 | 8/1973 | Lewkowitz | 52/501 |

FOREIGN PATENTS OR APPLICATIONS

| | | | |
|---|---|---|---|
| 976,659 | 12/1961 | United Kingdom | 52/502 |

*Primary Examiner*—Ernest R. Purser
*Assistant Examiner*—Henry Raduazo
*Attorney, Agent, or Firm*—Sughrue, Rothwell, Mion, Zinn & Macpeak

[57] ABSTRACT

There is disclosed a device for fixedly connecting panels for use in building of structures, in making of furniture or fittings, in which two sheets of panel are clamped by shaped materials for edge frame and pressing frame made of a hard synthetic resin or a metallic material such as aluminium or the like, said shaped material for edge frame being provided with recesses; a plug is fitted in each recess, said plug being made of a resilient synthetic resin or rubber and having a hole; and a wedge is inserted in said plug through said hole, thus two sheets of panel being firmly connected and retained in place.

1 Claim, 11 Drawing Figures

DEVICE FOR FIXEDLY CONNECTING PANELS FOR USE IN BUILDING

DESCRIPTION OF THE PRIOR ART

In the conventional method for connecting panels for use in building such as furniture or fittings, connection of panels has been made by means of screws or nails. This method, however, results in such disadvantages that damage on panel is so frequent at the time of replacement of a panel, due to damage thereon or change of facings for the purpose of rearrangement, the topmost panel must be first removed prior to the panel to be replaced. Accordingly, either attachment or replacement of the panel, especially that of two panels is troublesome and takes much time.

SUMMARY OF THE INVENTION

A primal object of the present invention is to provide a device for fixedly connecting two panels for use in building of structures, in making of furniture or fittings, in which connection of panels is effected by means of shaped materials for edge frame and pressing frame made of a hard synthetic resin or a metallic material such as aluminium or the like, a plug made of a resilient synthetic resin or rubber, and a wedge made of a hard material such as aluminium or the like, rather than by means of nails or screws, and therefore, there is no need for a tool.

Another object of the present invention is to provide a device for fixedly connecting panels for use in building, wherein two sheets of panel are clamped by such a simple work that a plug is inserted into the recess formed on the shaped materials for edge frame and pressing frame and a wedge is driven into a hole of said plug, thereby firmly securing panels. This device is especially fitted for the building of structures in the cold districts.

A still further object of the present invention is to provide a device for fixedly connecting panels for use in building, wherein, when replacement of a panel is required due to damage on the panel or change of facings or the like, replacement is easily workable, just by pulling the wedge out of the plug, then taking the plug out from the recesses formed by the edge frame and the pressing frame.

A still further object of the present invention is to provide a device for fixedly connecting panels for use in building, wherein changing of the ornamental pattern on the facings of said shaped material for frame is easily done just by changing the pressing frame of various designs.

A still further object of the present invention is to provide a device for fixedly connecting panels for building use, in which the device is applicable for setting any type of panels made of any kind of material and having any thickness; and good results can be obtained from the aesthetic point of view.

DETAILED DESCRIPTION OF THE INVENTION

Figure 1:
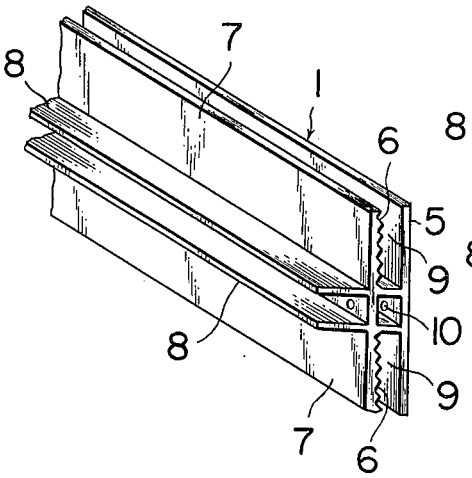
FIG. 1 is a perspective view showing the edge frame.
Figure 2:
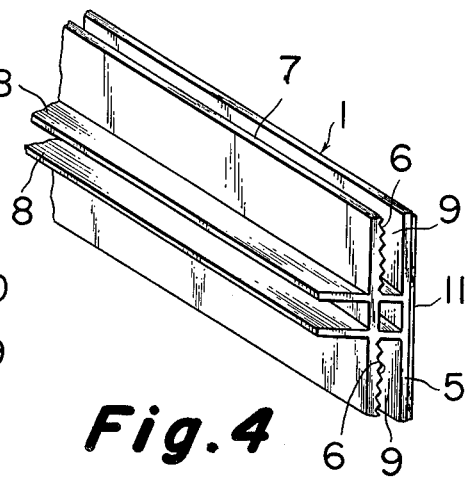
FIG. 2 is a perspective view showing an embodiment of the edge frame.

A device for fixedly connecting panels for use in building consists of an edge frame 1, a pressing frame 2, a plug 3 and a wedge 4.

The edge frame 1 shown in the drawing is a shaped material made of a hard synthetic resin or metal such as aluminium or the like. Said edge frame 1 has frame-board-adjoining plates 5 which extend perpendicularly from the point of sectional view and two pressing-frame-adjoining plates 7 which extend parallel to the frame-board-adjoining plates and have wave-like indent 6 inside. And two plates 8 adjoining the two panels are projected parallelly to each other and crossing with the said plate 7 at the right angle, and having an appropriate interval in between and connecting with said plate 5 at a right angle in the central part, and having a recess 9 on the upper and lower surfaces. And as shown in the drawing 1, holes for screws are drilled at equal length in the central part of said edge frame. Otherwise, as shown in drawing 2, without drilling holes for screws, an adhesive tape may be attached to the outer surface of said plate 5. The edge frame can be produced long, having a section in the shape as mentioned above, and can be cut to the appropriate length when in use.

Figure 3:
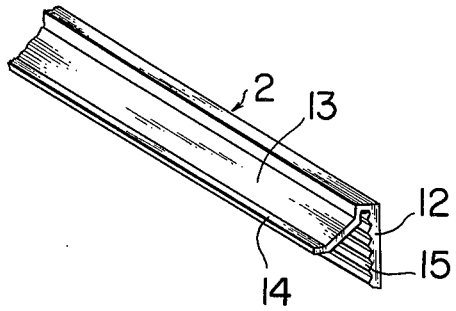
FIG. 3 is a perspective view of the pressing frame.

FIG. 3 shows the pressing frame 2. Said pressing frame 2 is made of a hard synthetic resin or a metallic material such as aluminium or the like, and is provided with a plate 12 adjoining to the edge frame, in which the upper half portion is bent obliquely downward to form an ornamental surface 13 and the upper end portion is further bent to the horizontal direction to form a plate 14 adjoining to the panels. Inside of said plate 12 adjoining to the panels is provided with wave-like indent 15. Said pressing frame 2 can be produced long, and can be cut to the appropriate length when in use.

Figure 4:
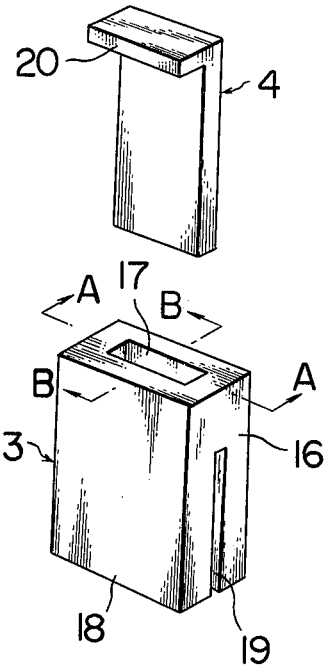
FIG. 4 is a perspective view of the plug and the wedge.
Figure 5:
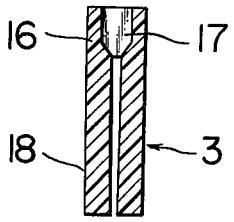
FIG. 5 is a longitudinal sectional view taken along the line A—A of the plug.
Figure 6:
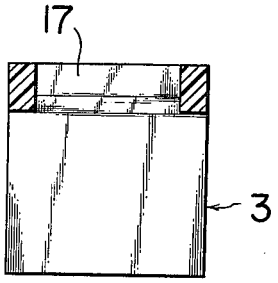
FIG. 6 is a longitudinal sectional view taken along the line B—B of the plug.

FIG. 4 shows the plug 3 and the wedge 4. FIGS. 5 and 6 show the plug 3, in which said plug 3 is made of a resilient synthetic resin or rubber and is provided at its upper head portion 16 with a hole 17, into which the wedge 4 is driven. The size and the shape of said hole substantially conform to the size and the shape of the wedge 4. Said plug 3 is split from the vicinity of the head portion 16 downwardly into two legs 18 with a spacing 19 interposed therebetween. The dimension of said spacing 19 formed between two legs 18 is smaller than the thickness of the wedge 4. Said spacing 19 is continuous to the hole 17 to form a guide spacing for the wedge 4. The plug 3 is fitted in each of the recesses 9.

Figure 7:
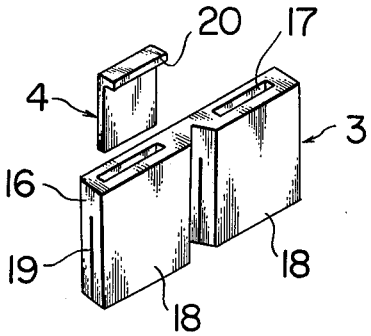
FIG. 7 is a perspective view of the plug and the wedge for use in the corner.
Figure 8:
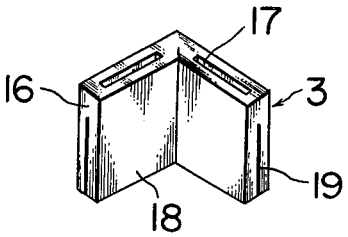
FIG. 8 is a perspective viw of the plug for use in the corner, bent view V-shape.

FIG. 7 shows the plug 3 for inserting into the corner portion. Said plug 3 has thin portion which runs longitudinally in the center, and is provided with holes 17 in the both head portion for inserting the wedge. When in use, the plug is bent at its thin portion in the center as shown in FIG. 8.

The wedge is made of a hard thin material such as metal and has substantially a uniform thickness throughout. A catch 20 is provided at a head portion of said wedge 4, substantially at a right angle, for the convenience of pulling out said wedge 4, after it has been fitted into the plug 3.

Figure 9:
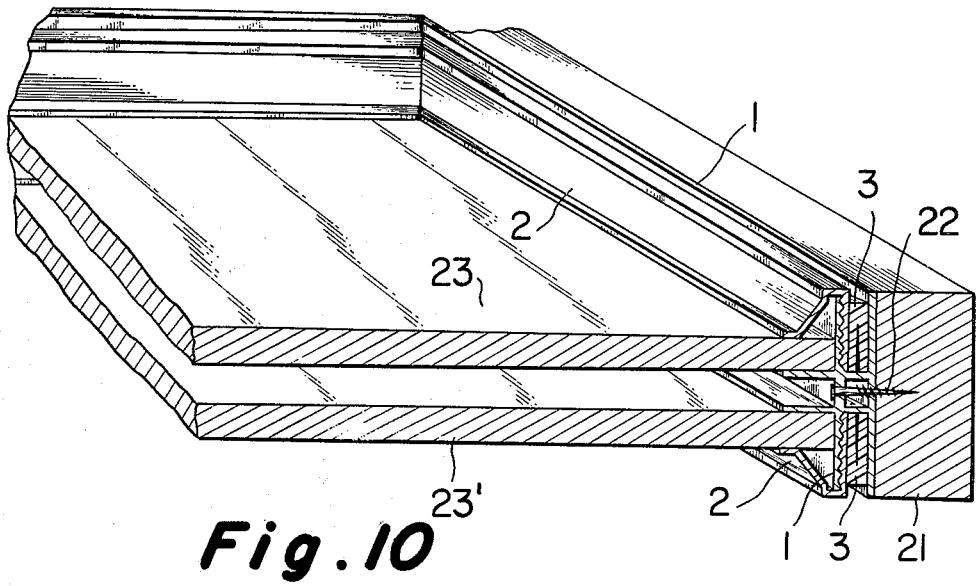
FIGS. 9–11 are views showing the edge frame, pressing frame and plug in use for fixing panels in a building structure.
Figure 10:
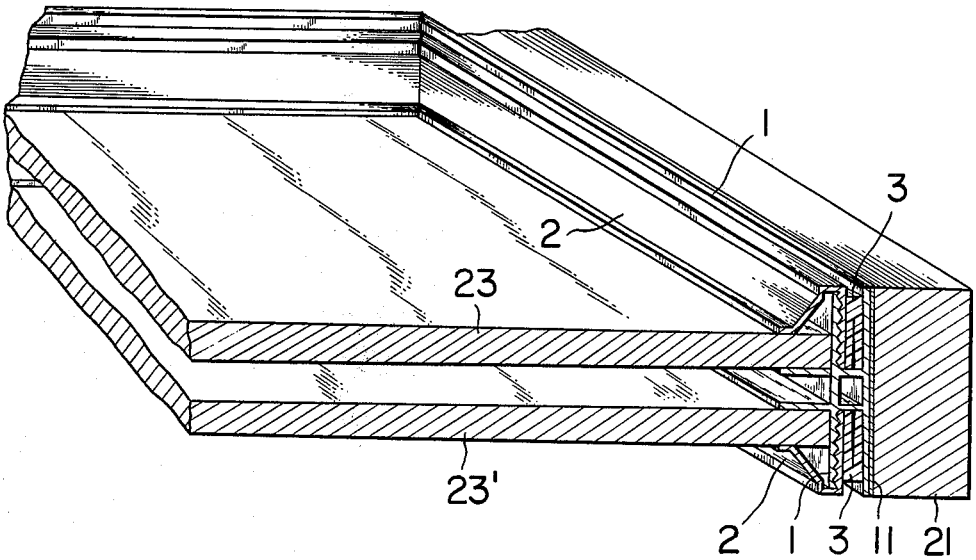
Figure 11:
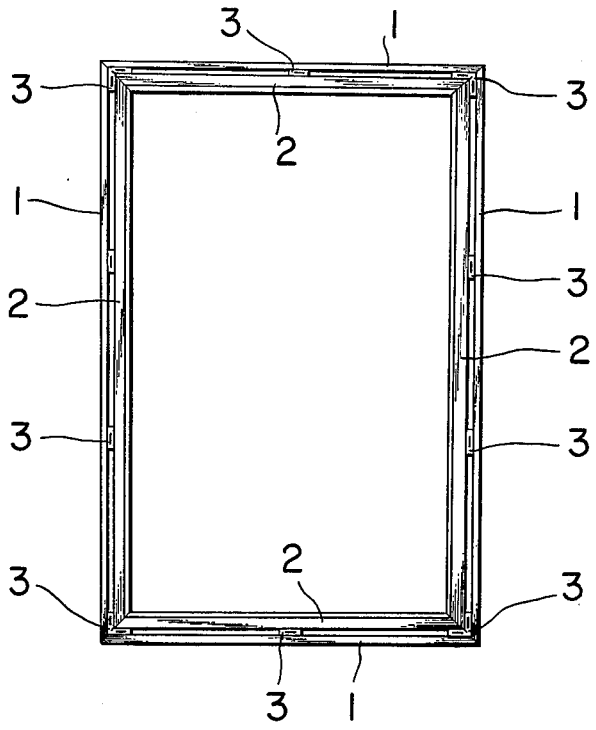

FIGS. 9 through 11 show the device in an embodiment. In fixing the device, first attaching the frame-board-adjoining plate 5 of said edge frame 11 to the panel board of building structure, furniture or fittings by driving a screw 22 into the screw hole 10 as shown in FIG. 9, or otherwise, as shown in FIG. 10, by using an adhesive tape which is attached to the surface beforehand, and then two sheets of panels 23, 23' are fitted to the upper and lower surfaces of the plate 8. And After that, on the wave-like indent 6 on said edge frame 1 is attached the wave-like indent of said pressing frame 2, and holding the panels 23, 23' between the plate 8 of said edge frame 1 and plate 14 of pressing frame, the plug 3 is inserted into the recesses 9, and the wedge 4 is plugged into the holes 17 of the plug 3, thereby pressing the edge frame 1 and the pressing frame 2 so as to firmly fix the two sheets of panel 23, 23'.

And the replacement of the two panels 23, 23', can be executed in the opposite way of fixing. First pulling out the wedge 4 and then the plug 3, replacement is easily done.

This device can be applicable for fixedly connecting not only the wooden panels but also other panels such as sheet glass or acrylic board.

What we claim is:

1. A dual panel mounting frame comprising at least one edge frame member having a first pair of parallel spaced apart plates, connecting means extending transversely between said first pair of plates intermediate the edges thereof to define two opposed edge opening recesses between said plates, a second pair of parallel spaced apart plates integral with and extending perpendicular to one of said first pair of plates adjacent said connecting means, a pair of substantially V-shaped pressing frame members, each pressing frame member having a first plate adjustably extending into one of said recesses in engagement with one of said first pair of plates and a second plate extending towards said second pair of plates to grip a pair of panels between said second pair of plates and said pressing members and expandable plug means disposed in said recesses to force said first plate of each of said pressing frame members into tight engagement with said one of said first pair of plates; said expandable plug means being provided with an aperture and further comprising wedge means adapted to be driven into said aperture to expand said plug means.

* * * * *